US007704086B2

(12) United States Patent
Gimbel et al.

(10) Patent No.: US 7,704,086 B2
(45) Date of Patent: Apr. 27, 2010

(54) SEALED PLUG CONNECTION THROUGH A PARTITION WALL AND METHOD OF FITTING

(75) Inventors: Markus Gimbel, Baar-Ebenhausen (DE); Stefan Glaser, Heppenheim (DE); Richard Forell, Lorsch (DE); Joachim Schneider, Lampertheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/599,643

(22) PCT Filed: Mar. 23, 2005

(86) PCT No.: PCT/EP2005/003122

§ 371 (c)(1),
(2), (4) Date: Oct. 4, 2006

(87) PCT Pub. No.: WO2005/101583

PCT Pub. Date: Oct. 27, 2005

(65) Prior Publication Data

US 2007/0197074 A1 Aug. 23, 2007

(30) Foreign Application Priority Data

Apr. 7, 2004 (DE) ..... 10 2004 017 275

(51) Int. Cl.
*H01R 13/62* (2006.01)

(52) U.S. Cl. ..... 439/157; 439/372; 439/271

(58) Field of Classification Search ..... 439/157, 439/159, 271, 587, 372
See application file for complete search history.

(56) References Cited

U.S. PATENT DOCUMENTS

| | | | | |
|---|---|---|---|---|
| 5,279,507 | A | 1/1994 | Kameyama | |
| 5,322,448 | A | 6/1994 | Hahn | |
| 5,389,015 | A | 2/1995 | Sasai et al. | |
| 5,613,876 | A | 3/1997 | Sakatani et al. | |
| 5,785,552 | A | 7/1998 | Uchida | |
| 5,971,791 | A | 10/1999 | Itoh et al. | |
| 6,113,407 | A | 9/2000 | Martin | |
| 6,183,275 | B1 * | 2/2001 | Okura et al. | 439/157 |
| 6,361,362 | B1 | 3/2002 | Kressmann et al. | |
| 6,464,522 | B2 * | 10/2002 | Osawa et al. | 439/271 |
| 6,773,278 | B2 * | 8/2004 | Valasek et al. | 439/157 |
| 6,953,357 | B2 * | 10/2005 | Fukushima et al. | 439/271 |
| 2003/0109166 | A1 | 6/2003 | Ookura | |

FOREIGN PATENT DOCUMENTS

| | | | |
|---|---|---|---|
| DE | 37 09 461 | A1 | 10/1987 |
| DE | 298 23 075 | U1 | 6/2000 |

(Continued)

*Primary Examiner*—Hien Vu
(74) *Attorney, Agent, or Firm*—Barley Snyder LLC

(57) ABSTRACT

A plug connection comprises a first plug having a seal and a second plug configured for fitting in an opening in a partition wall. The second plug is mateable with the first plug such that the seal substantially surrounds the opening in the partition wall. A clamping device is provided on the first plug and is configured for drawing the first plug into engagement with the second plug. The clamping device engages with the second plug at a connection region. The connection region is provided with a sealing member configured to seal the connection region between the clamping device and the second plug.

11 Claims, 18 Drawing Sheets

FOREIGN PATENT DOCUMENTS

| | | | |
|---|---|---|---|
| DE | 199 32 113 | A1 | 1/2001 |
| DE | 199 33 933 | A1 | 1/2001 |
| DE | 103 20 460 | A1 | 12/2003 |
| EP | 0 556 762 | A1 | 8/1993 |
| EP | 0 572 012 | A1 | 12/1993 |
| EP | 0 591 972 | A2 | 4/1994 |
| EP | 1 318 570 | A1 | 6/2003 |
| WO | WO 97/08783 | | 3/1997 |

* cited by examiner

Detail D

SEALED PLUG CONNECTION THROUGH A PARTITION WALL AND METHOD OF FITTING

FIELD OF THE INVENTION

The present invention relates to a plug connection for producing at least one electrical connection through an opening in a partition wall. The plug connection, which is also known as a through plug, comprises a first and a second plug, which can be plugged together, and at least one of the plugs can be sealed from the partition wall by means of a seal that surrounds the opening. The invention relates, in particular, to a plug connection, wherein at least one of the plugs of said connection comprises a clamping device which can be engaged with the other plug and enables the two plugs to be drawn permanently in the direction in which they are plugged together with the partition wall therebetween. The invention also relates to a method of fitting for producing an electrical plug connection of this type.

BACKGROUND OF THE INVENTION

With a known generic plug of the type shown, for example, in published international patent application WO 2004/047234 A1, two plugs are clamped to one another with a partition wall therebetween by a slideable clamping device which is displaceable for clamping the two plugs in a direction substantially transverse to a direction of a passage through the partition wall. Guide rails convert the pushing force into a clamping force.

However, this known clamping device is accompanied by the problem that moisture can penetrate at joints between the clamping device and the plugs, which can lead to failure of the plug connection.

BRIEF SUMMARY OF THE INVENTION

It is accordingly an object of the invention to provide a plug connection and a method of fitting the same, wherein the plug connection has an improved seal positioned at a partition wall and a sealing member positioned in a connection region in order to increase security of the connection.

A further object of the invention is to provide a plug connection and a method of fitting the same, wherein at least one plug of the plug connection can be fixed as easily as possible on a partition wall and fitting errors can easily be detected.

The present invention is based on the fundamental idea that the undesirable penetration of moisture into an interior of a plug connection can be avoided if a connection region between a clamping device and at least one plug of the plug connection is sealed by a sealing member positioned on a bearing projection. According to an advantageous embodiment, the clamping device comprises at least one actuating projection which co-operates with a socket arranged on one of the plugs, to clamp the plug. The force applied during clamping can easily be converted into a clamping force in this way.

In order to minimize the region which a sealing member of this type has to seal, the clamping device in an advantageous embodiment can comprise a locking lever which, for clamping the plugs, is pivotal about an axis of rotation extending substantially transversely to a direction of a passage through the partition wall. With an arrangement of this type, it is merely necessary to seal the region in which the locking lever is rotatably mounted.

In order to achieve particularly effective conversion of power from a pivoting movement into a clamping force for clamping the plugs, at least one tooth with involute tooth faces can be arranged on each bearing projection as an actuating projection.

According to an advantageous embodiment, the clamping device comprises a locking lever with a base region and two leg regions. The bearing projections, which are rotatably connected in corresponding bearing recesses in one plug, are formed on leg regions. In this way, the locking lever can be made, in a particularly simple manner, to be pivotal about the axis of rotation extending substantially transversely to the direction of the passage through the partition wall, in order to clamp the plugs. The sealing member can then be arranged on the bearing projections, for example, in the form of an O-ring or, alternatively, is sprayed directly onto the bearing projections.

A particularly inexpensive, simple embodiment of the sealing member according to the invention is achieved if the sealing member is formed by a resilient O-ring and positioned on a bearing projection.

The seal at the partition wall has to be arranged peripherally around an opening in the partition wall. According to an advantageous embodiment, the seal can be sprayed onto an outer periphery of the plug, so the seal is arranged captively on the plug housing. In addition, the connection between the seal and the plug, on which it is sprayed, is always completely tight. However, this seal can also be a separate member which can be brought into contact with both the plug and the partition wall.

To prevent unintentional release of the clamping device, a separate securing device, which is also described as a connector position assurance (CPA) member, can be provided to secure the clamping device in a finally fitted state.

The securing device is releasable in a particularly compact manner if it is displaceable in a direction transverse to the direction of the passage through the partition wall.

A catch lug, which is provided for latching the clamping device on the securing device, represents a particularly effective, easily produced locking member.

A correspondingly sealed sliding clamping device can also be used as an alternative to the pivotal locking lever, and this is beneficial, for example, if the available space does not allow pivoting of the locking lever during fitting. The clamping device can be a sliding device comprising at least one step-up or step-down arrangement. This allows an applied sliding force or movement to be transformed into a greater or smaller clamping force or movement.

It is particularly advantageous if the clamping device is a sliding device which is displaceable in a direction substantially transverse to a direction of a passage through the partition wall, in order to clamp the plug. This results in a particularly simple clamping device on the plug connection, and the clamping can be carried out very quickly and easily and the necessary space can be minimized.

In a further advantageous embodiment of the invention, the clamping device can comprise at least one guide rail which extends in part in a plane longitudinally to the plugging-together direction and substantially transversely to the plugging-together direction. This enables a sliding force or movement to be transformed into a clamping force or movement.

If the sealing member is provided on an opening of a first plug housing, through which an engagement element of the clamping device dips, then a clamping device configured as a sliding device can be particularly effectively sealed from penetrating moisture. A seal of this type can be sprayed on, for example, and can also have complicated cross sections, for example with at least one sealing lip, to improve the tightness.

A particularly reliable seal, which can be produced with minimal force, can be achieved if at least one sealing projection, which cooperates with the sealing member to seal the plug connection, is formed on a second plug housing.

Since a locking device is additionally provided, which is movable between a locked position, in which the second plug is fixed on the partition wall, and an unlocked position, particularly secure fixing of the second plug on the partition wall can be achieved. A locking device of this type, which can also be described as a connector position assurance (CPA) member, can be constructed in such a way that unlocking is also possible and the second plug can easily be removed from the partition wall in the event of a repair. On the other hand, if relatively great forces have to be applied when plugging in the first plug, it is possible to ensure that the second plug is not unintentionally released from the partition wall. In particular, if this second plug is held in a vehicle body panel, of which the back is not readily accessible at the moment of plugging together, as is the case, for example, with a car door, the solution according to the invention avoids the situation where the second plug can no longer be correctly contacted. Since the locking device is mechanically fixed in the unlocked position, a defined position of the locking device can be ensured in the pre-fitted state.

At least one catching device can also be arranged on the locking device in order to secure the locking device in cooperation with an associated latching opening in the locked position. This is particularly important in applications in the automotive industry, in which pronounced mechanical and thermal stresses occur during operation.

To prevent the locking device from unintentionally moving from the unlocked position, the at least one catching device can cooperate, in the unlocked position, with a further associated catch opening, in order also to fix the locking device in this position. This catching connection is expediently accessible from the exterior (at least to a suitable tool), so that it is releasable, should removal be desired.

In the simplest case, the locking device can be displaceable relative to the second plug in the direction in which the plugs are plugged together. However, this solution has the drawback that it cannot be ensured that the plugs are plugged-in only when the locking device is correctly located in its locked position. In order to ensure, in a particularly simple manner, that the two can be plugged-in only if the second plug is located in its final position in the opening in the partition wall and the locking device is correctly locked, the locking device can be mounted on the second plug housing by means of a hinge-like connection and be movable between the locked and the unlocked position by a pivoting movement about an axis of rotation extending substantially transversely to a direction of a passage through the partition wall.

In an embodiment of this type, for example, an edge region remote from the axis of rotation can then be arranged in the second plug housing in such a way that the plugs can not be plugged together in the unlocked state.

The locking device proposed in conjunction with the present clamping device can obviously also be used for other plug connections.

BRIEF DESCRIPTION OF THE DRAWINGS

The invention is described in more detail hereinafter with reference to the embodiments illustrated in the accompanying drawings. Like or corresponding parts of the plug connection according to the invention are provided with like reference numerals in the figures, in which.

DETAILED DESCRIPTION OF THE INVENTION

Figure 1:
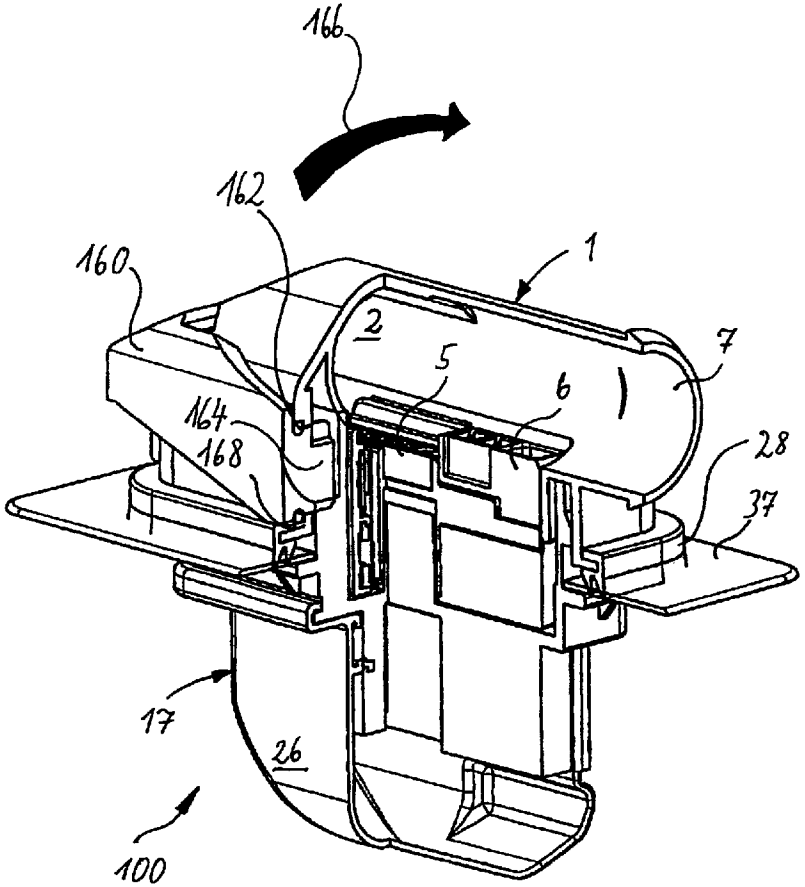
FIG. 1 is a perspective, partially open view of a plug connection according to a first embodiment showing first and second plugs fitted in an opening in a partition wall.

FIGS. 1-6 show a plug connection 100 according to a first embodiment of the invention. As shown in FIG. 1, the plug connection 100 comprises a first plug 1 and a second plug 17. The second plug 17 is fitted in a partition wall 37. According to the present embodiment, the second plug 17 is a pin-type plug and the first plug 1 is a corresponding socket-type plug, however, this arrangement is not essential to the present invention as the arrangement could also be reversed.

According to the invention, the first plug 1 is sealed from the partition wall 37 by means of a peripheral seal 28. As will be described hereinafter with reference to FIGS. 3 and 4, the plug connection 100 according to the invention comprises a clamping device which, in a final fitted position shown in FIG. 1, draws the first and second plugs 1, 17 together with the partition wall 37 therebetween. According to a first embodiment of the invention, the clamping device is formed as a locking lever 160. The first plug 1 comprises a first plug housing 2, a connecting piece 7, to which a bush (not shown) can be attached, a first pin recess 5, and a second pin recess 6. The bush (not shown) and the connecting piece 7 form part of a channel through which a cable (not shown) can be introduced into an interior of the first plug housing 2.

To prevent the penetration of moisture into the interior of the first plug 1 at the connection point between the first plug housing 2 and the locking lever 160, the first plug 1, according to the invention, has a sealing member 162. In the embodiment illustrated, the sealing member 162 is embodied by a simple O-ring. However, other methods of producing the sealing member 162 can also be employed such as, for example, spray-on seals or seals of complex shape comprising, for example, sealing lips.

As shown in FIG. 1, the sealing member 162 is arranged on a bearing projection 164 which holds the locking lever 160 pivotally in a direction of arrow 166 in a bearing recess 168 of the first plug housing 2. Owing to the specific configuration of the sealing member 162 as an O-ring, the seal provided by the sealing member 162 can be ensured in a particularly simple manner despite the movability of the locking lever 160.

Figure 2:
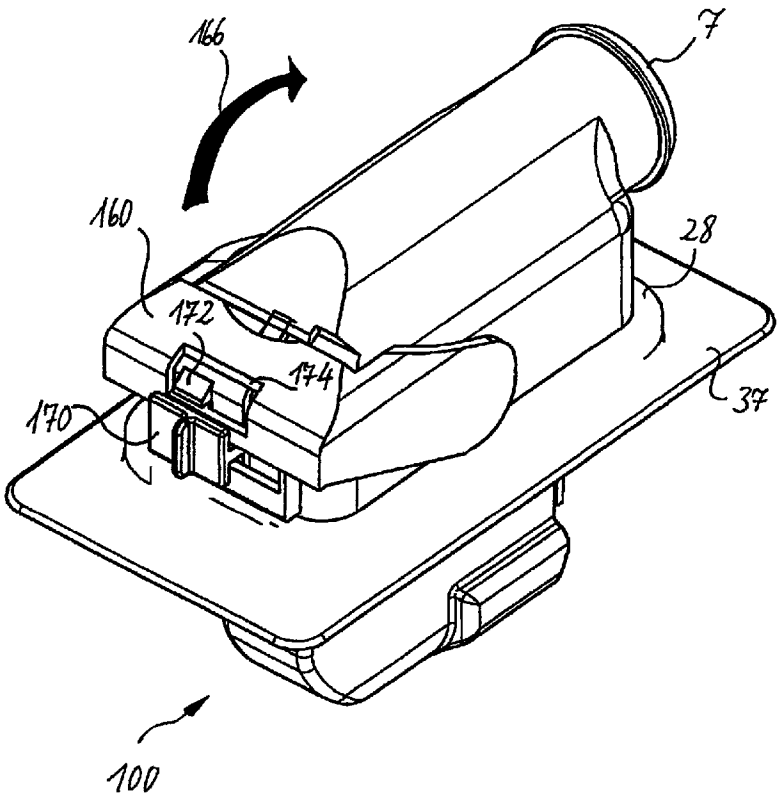
FIG. 2 is a perspective view of the plug connection according to the first embodiment rotated relative to the view in FIG. 1.

To illustrate the construction of the locking lever 160, the plug connection 100 according to the invention is shown in a rotated perspective view in FIG. 2. This view shows that the locking lever 160 is protected from unintentional unlocking in the direction of the arrow 166 by a securing device 170. The securing device 170 comprises a catching device 172 for latching with a catch opening 174 of the locking lever 160. With this arrangement, the locking lever 160 can be prevented from pivoting unintentionally so that the seal between the first and second plugs 1, 17 is not unintentionally released, on the one hand, and the catching device 172 is easily accessible from an exterior of the first plug housing 2 so that the catching device 172 can be opened if necessary (at least with a suitable tool), on the other hand.

Figure 3:
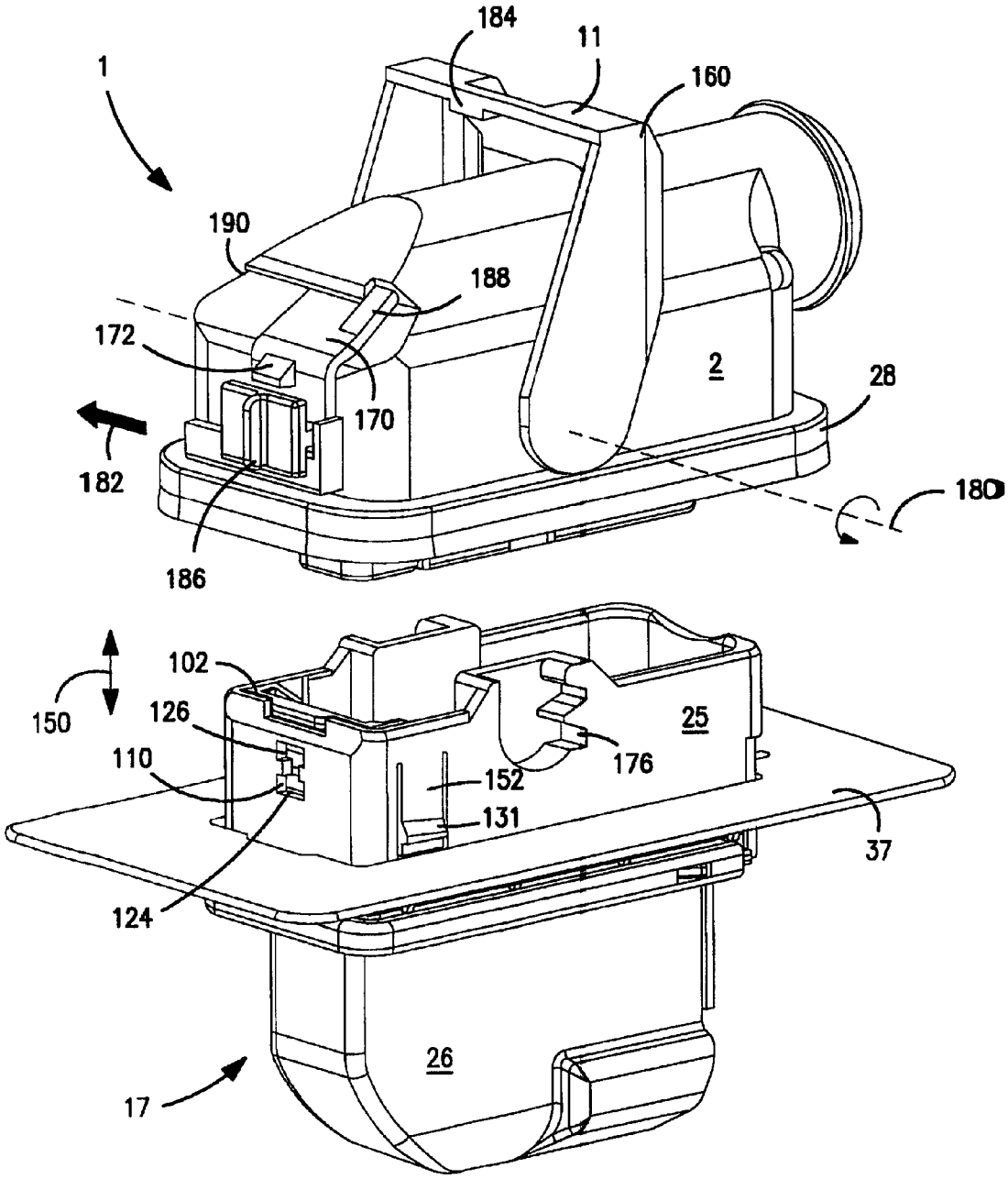
FIG. 3 is a perspective view of the plug connection according to the first embodiment, in which the second plug is held in the opening in the partition wall and the first plug is positioned in a state ready for fitting prior to plugging together.

FIG. 3 shows the first embodiment of the plug connection 100 according to the invention in an unfitted state. The second plug 17 is already fitted in the partition wall 37. A resilient catch arm 152 with a catch lug 131 are formed on a second plug housing 25 and secure the second plug 17 in an opening 39 in the partition wall 37. Space can additionally be saved during fitting as the second plug 17 does not yet have to rest securely on the partition wall 37 in this unfitted state but, if necessary, is still displaceably mounted. The second plug 17 is not drawn toward the partition wall 37 and pressed thereon until the second plug 17 is engaged with the first plug 1 and the engagement therebetween is tightened by the locking lever 160. An engagement element 176 in the form of a recess engages with an actuating element 178 (FIG. 4) in the form of a projection formed on the locking lever 160 for drawing the first and second plugs 1, 17 against the partition wall 37. With regard to its operating principle, the engagement element 176 is configured as a reduced rack, which cooperates with the actuating element 178 configured as part of a gear-wheel.

To prevent the second plug 17 from falling out of the partition wall 37 when undergoing mechanical stress during fitting, a locking device 102 is further provided, which operates by blocking inward deflection of the catch arm 152 in the locked state so that the second plug 17 can no longer fall out of the opening 39. In the illustrated embodiment, the resilient catch arm 152 is formed integrally on the plastic second plug housing 25 of the second plug 17.

Figure 5:
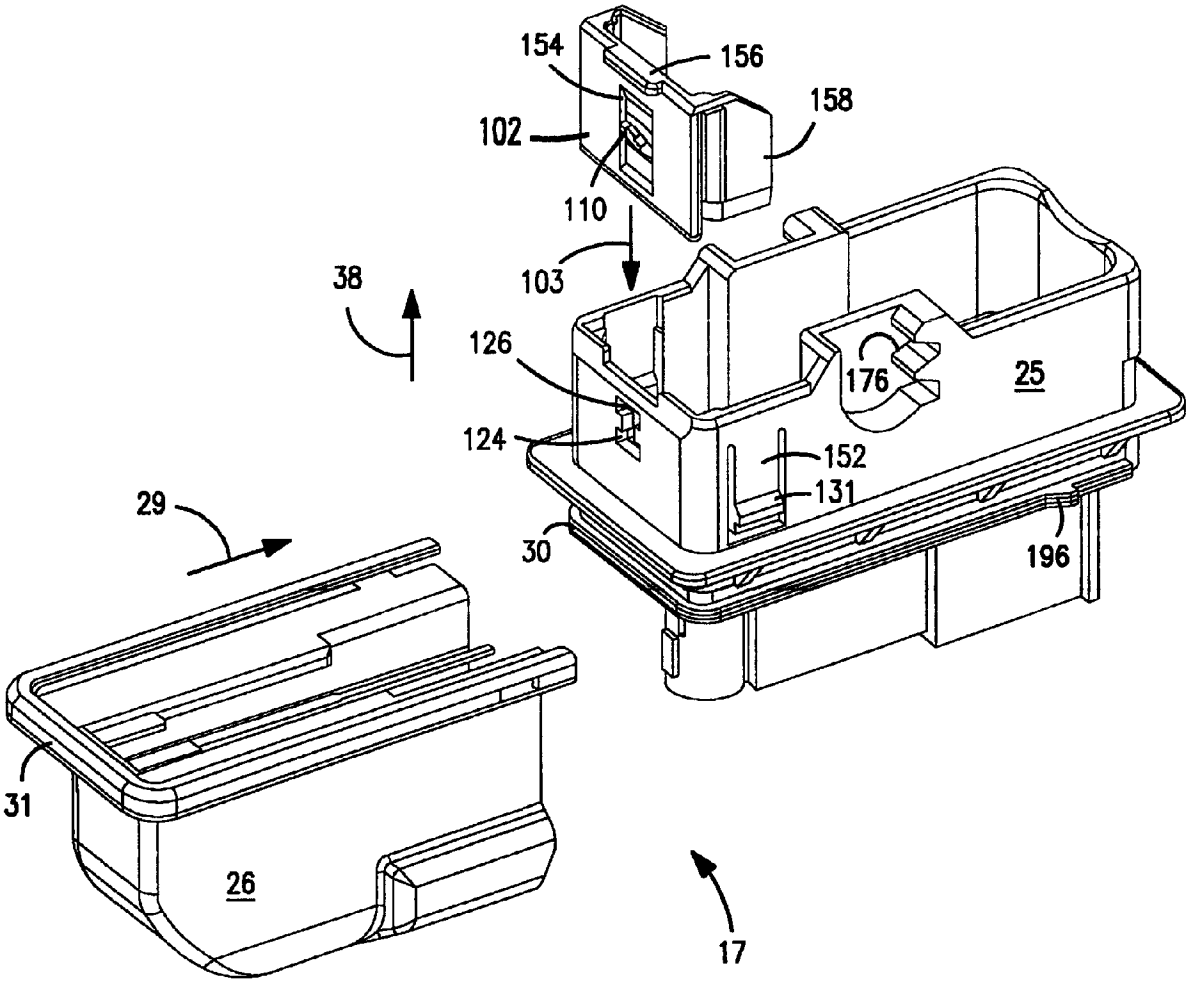
FIG. 5 is a perspective, partially exploded view of the second plug according to the first embodiment.

As shown in FIG. 5, the locking device 102 comprises a catch lug 110, which in both the locked and the unlocked state, latches in a corresponding catch opening 124, 126 so that the locking device 102 is captively secured in both positions. The locking device 102 is movable between the locked position and the unlocked position in a direction of arrow 150 (FIG. 3), which is in the direction in which the first and second plugs 1, 17 are plugged together. This is advantageous, in particular, because the locking device 102 can therefore be accessed particularly easily from an exterior of the second plug housing 25 and can easily be locked and unlocked by a user. Two elongated cut outs 154 also allow flexible movability of the catch lug 110. An actuating projection 156 simplifies operation of the locking device 102 by a user. Faces 158 are configured to block the catch lugs 131 in the locked state. A drip proof cap 26 covers the second plug 17 and thus protects the second plug 17 from the penetration of drips.

The first plug 1 is shown in FIG. 3 with the locking lever 160 pivoted upwards. The securing device 170, which is displaceably mounted on the housing 2, is located, in the illustrated view, in a position in which latching with the catch lug 172 is permitted during subsequent pivoting of the locking lever 160. Once the locking lever 160 has pivoted about an indicated axis of rotation 180, the securing device 170 can be pushed in a direction of arrow 182 so that the catch lug 172 engages with a projection 184 on the locking lever 160 and holds the locking lever 160 securely in the locked position. An actuating projection 186 simplifies the displacement of the securing device 170. To ensure secure guidance, the securing device 170 is also displaceably held in corresponding grooves 190 on the first plug housing 2. Finally, a securing tab 188 is formed on the securing device 170 to prevent displacement of the securing device 170 in a direction of arrow 182 until it is pressed against the first plug housing 2 by the folded down locking lever 160 and allows the securing tab 188 to be displaceable into the groove 190.

Figure 4:
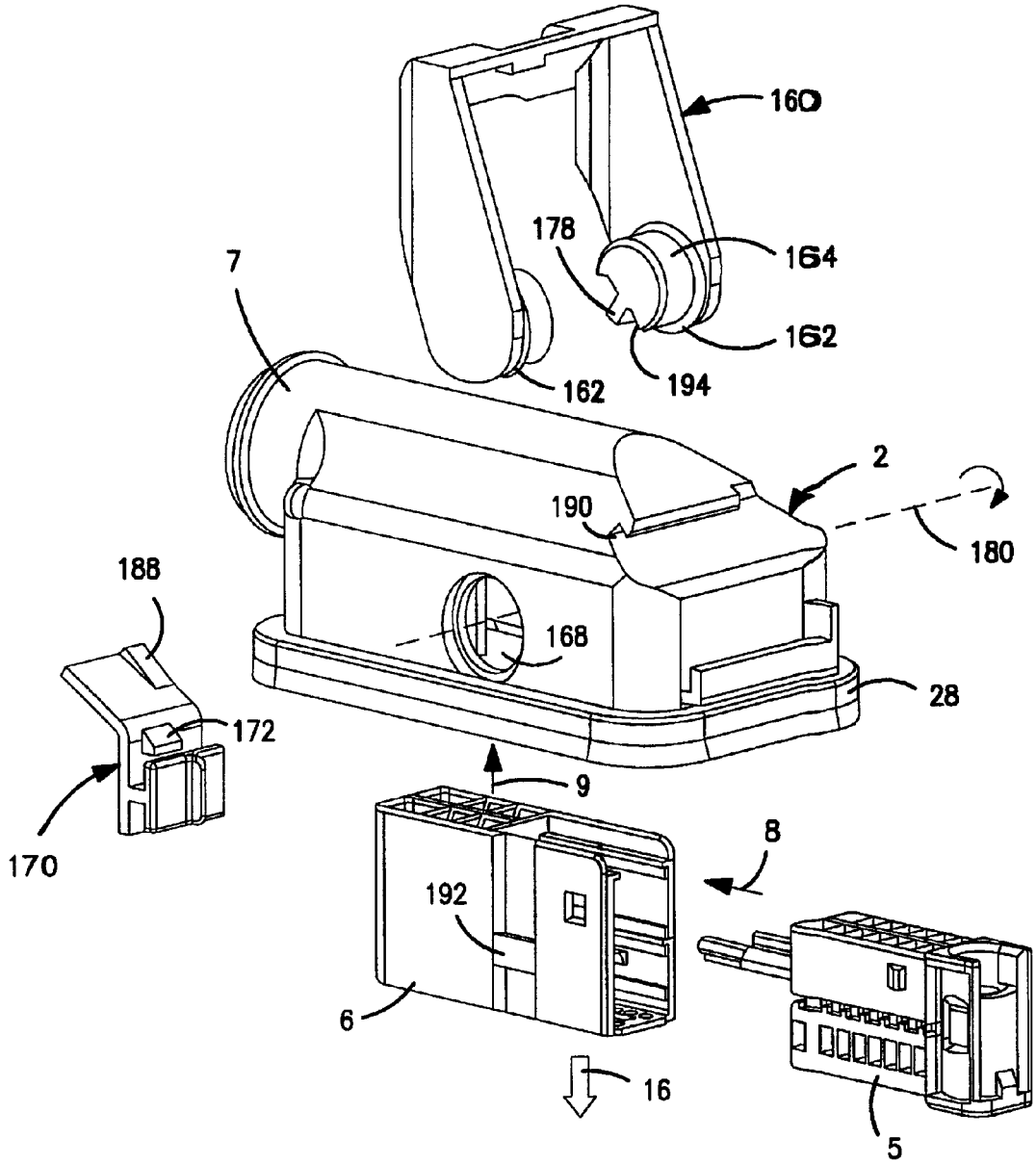
FIG. 4 is a perspective, partially exploded view of the first plug according to the first embodiment.

Referring to FIG. 4, the first and second pin recesses 5, 6 are configured to be complementary to one another in certain regions so that the first pin recess 5 can be inserted into the second pin recess 6 in a direction of arrow 8 in certain regions. In the plugged together state, the first and second pin recesses 5, 6 can be introduced into the interior of the first plug housing 2 in a direction of arrow 9. A catch device 192 ensures that the first and second recesses 5, 6 are held securely in the first plug housing 2. In accordance with the invention, the first plug housing 2 comprises substantially circular bearing recesses 168 through which the bearing projections 164 are received to allow rotatability about the axis of rotation 180.

According to the invention, the sealing member 162 is pushed over the respective bearing projections 164 as shown in FIG. 4. This sealing member 162 prevents the penetration of moisture through the bearing opening 168 into the interior of the first plug housing 2. The first plug housing 2 is sealed from the partition wall 37 in the fitted state via the seal 28. This seal 28 can either be sprayed on or be produced as a prefabricated part made, for example, of silicone rubber, and fitted on the first plug housing 2. The locking lever 160 has a substantially U-shaped configuration with two legs, on which the bearing projections 164 are formed, and a base which engages with the securing device 170. The fact that the locking lever 160 partially surrounds the housing 2 allows an arrangement which is as compact as possible to be produced.

A portion of a gear-wheel which engages with the corresponding engagement elements 176 on the second plug housing 25 is constructed on the bearing projection 164 as the respective actuating element 178 shown in FIG. 4. Advantageously, the actuating element 178 is configured to have at least one tooth with an involute tooth face 194. The actuating element 178 withstands all the force in the finally fitted state and is formed on the solid material of the bearing projection 164 to allow better absorption of force and long-term stability.

Figure 6:
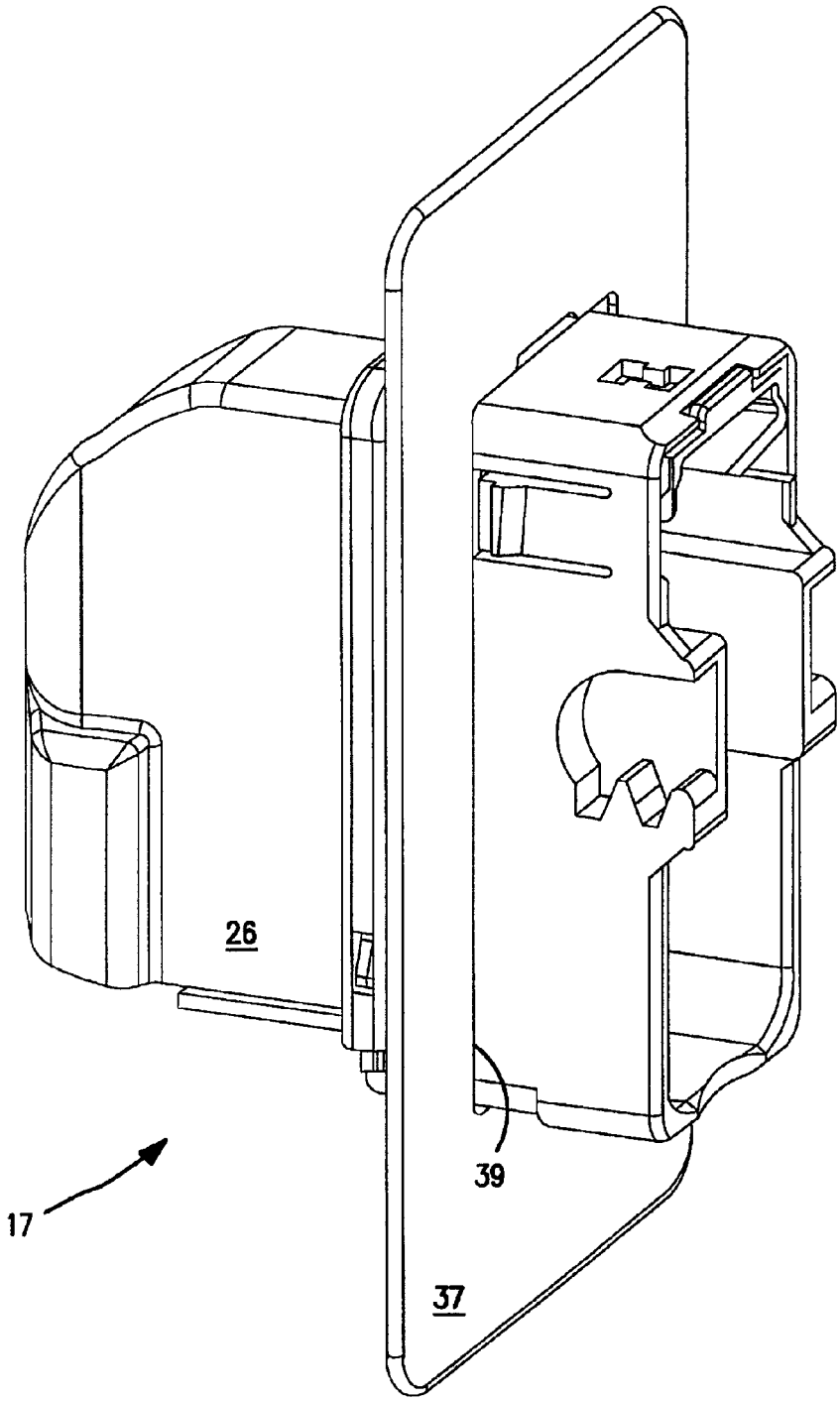
FIG. 6 is a perspective view of the second plug held in the partition wall according to the first embodiment.

As shown in FIG. 5, the second plug 17 has the second plug housing 25, the drip proof cap 26, and the locking device 102. The drip proof cap 26 can be slid onto the second plug housing 25 in a direction of arrow 29. An outer periphery 30 of the second plug housing 25 engages with an encompassing rim 31 of the drip proof cap 26. Once fitted, the drip proof cap is secured on the plug housing 25 by a catch 196. FIG. 6 shows the second plug 17 held in the partition wall 37 in a state ready for plugging.

Operation of the first embodiment of the plug connection 100 shown in FIGS. 1 to 6 will be described hereinafter.

The first plug 1 is initially pre-fitted. Referring to FIG. 4, the first pin recess 5 is introduced into the second pin recess 6 in certain portions in the direction of the arrow 8. In this state, the first and second pin recesses 6, 5 are inserted into the interior of the first plug housing 2 in the direction of the arrow 9. A bush (not shown) can then be pushed over the connecting piece 7 in certain regions. In addition, pins are fitted in the first and second pin recesses 5, 6 and a supply cable (not shown) is laid through the interior of the bush (not shown) into the interior of the first plug housing 2. Conductors of the supply cable (not shown) are connected to the corresponding pins, in order to fit the first plug 1.

The second plug 17 is fitted independently of the first plug 1. In particular, the drip proof cap 26 is pushed onto the second plug housing 25 in the direction of the arrow 29 as shown in FIG. 5. Pins are also inserted into the second plug 17 and one or more supply lines are laid therein.

A connection can now be produced through the opening 39 in the partition wall 37 using the plug connection 100 according to the invention. The connection is an electrical connection in this embodiment.

Referring to FIGS. 5 and 6, the second plug 17 is guided through the opening 39 in the partition wall 37 in a direction of arrow 38. Guidance continues until the catch lugs 131 are secured on the partition wall 37. The locking device 102 is subsequently introduced into the second plug housing 25 in the direction of the arrow 103 and pushed down until it latches in the catch opening 124 and is thus secured against bending inwards by the faces 158 of the catch arm 152, so the second plug 17 is now secured captively in the partition wall 37. In car production, this can be a pre-fitted state.

The first and second plugs 1, 17 can now be plugged together. Starting from the position of the first and second plugs 1, 17 shown in FIG. 3, the first plug 1 is guided onto the second plug 17 in the direction of the arrow 150 and plugged together with the second plug 17. A force is then applied to the actuating face 11 of the locking lever 160 so that the locking lever 160 is pivoted about the axis of rotation 180 and the force exerted is converted into a clamping movement by the actuating element 178 (FIG. 4) and the engagement element 176. Tension is thus built up until the actuating element 178 reaches its end position in the engagement element 176. The catch hook 172 also engages with the catch opening 174 (FIG. 2). In the next step, the securing device 170 is displaced in the direction of the arrow 182 (see FIG. 3), so that the catch hook 172 is secured on the projection 184 and the locking lever 160 is held against unintentional movement from the end position now adopted. Owing to the mechanical stress, the seal 28 is pressed against the partition wall 37 so that, together with the sealing member 162 of the locking lever 160, the first plug 1 is reliably protected from penetrating moisture in this position.

A second embodiment of the plug connection 100 according to the invention will now be described with reference to FIGS. 7 to 16.

Figure 7:
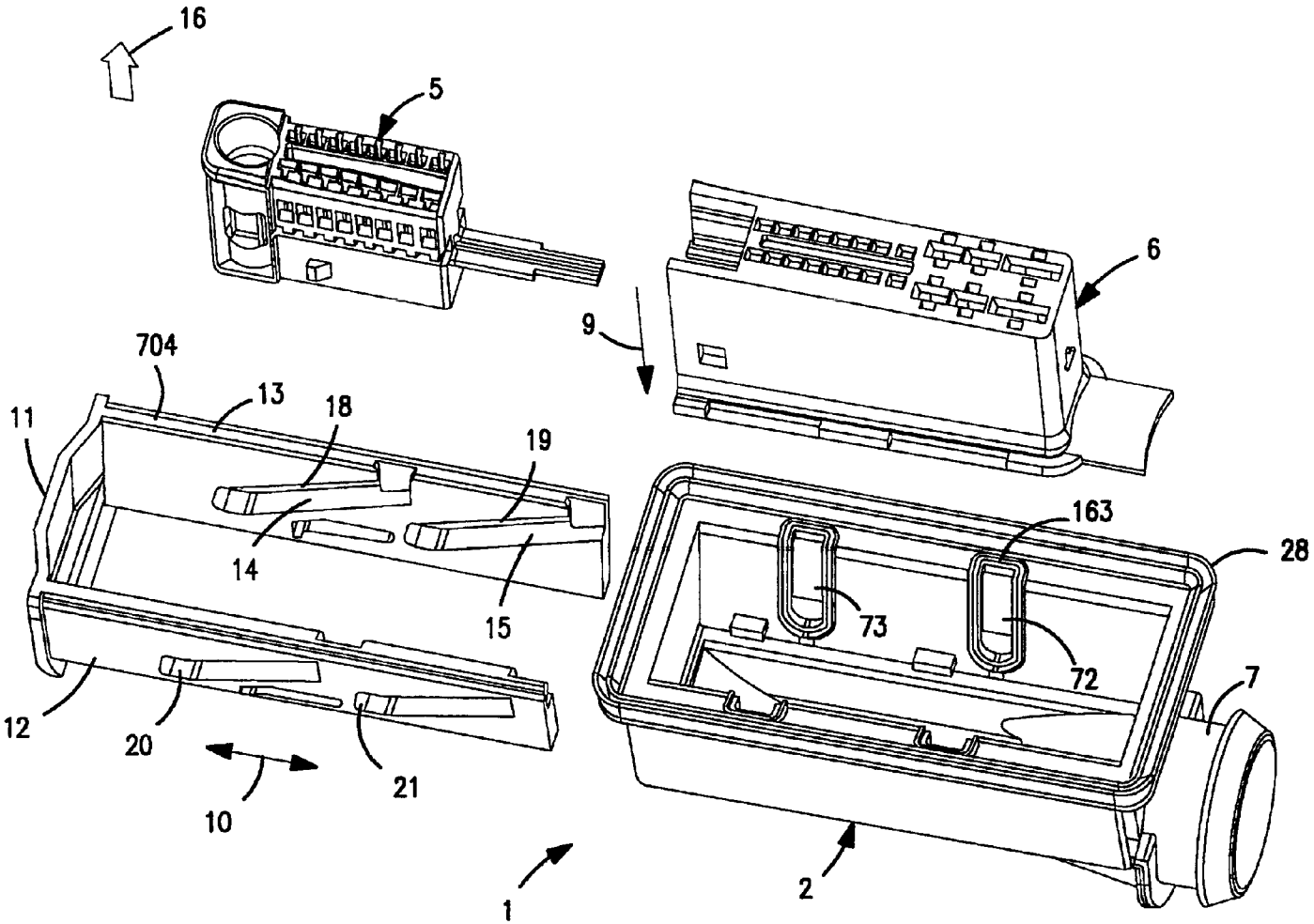
FIG. 7 is a perspective, partially exploded view of a first plug according to a second embodiment.

Referring to FIG. 7, the first plug 1 according to the second embodiment comprises a sliding device 704, instead of the clamping device configured as the locking lever 160, for clamping the first and second plugs 1, 17 together. The sliding device 704 is accommodated displaceably in the first plug housing 2 in a direction of arrow 10. The sliding device 704 comprises an actuating surface 11, to which a displacement force can be applied for displacing the sliding device 704.

The sliding device 704 comprises side elements 12, 13. As shown in FIG. 7, respective upper guide rails 14 and lower guide rails 15 are provided in the side elements 12, 13. The upper and lower guide rails 14, 15 are formed, for example, as guide recesses in this embodiment of the invention.

In FIG. 7, a proposed direction for plugging together the first plug 2 and the second plug 17 is indicated by arrow 16. The direction of the arrow 10, in which the sliding device 704 can be displaced in the first plug housing 2, extends substantially transversely to the direction of the arrow 16 for plugging together the first plug 1 and the second plug 17. The upper and lower guide rails 14, 15 have step-down portions 18, 19 which extend in a direction substantially transverse to the plugging-together direction shown by the direction of the arrow 16 and substantially transverse to the sliding direction shown by the direction of the arrow 10. The upper and lower guide rails 14, 15 also comprise end portions 20, 21 which extend parallel to the sliding direction shown by the direction of the arrow 10.

Figure 8:
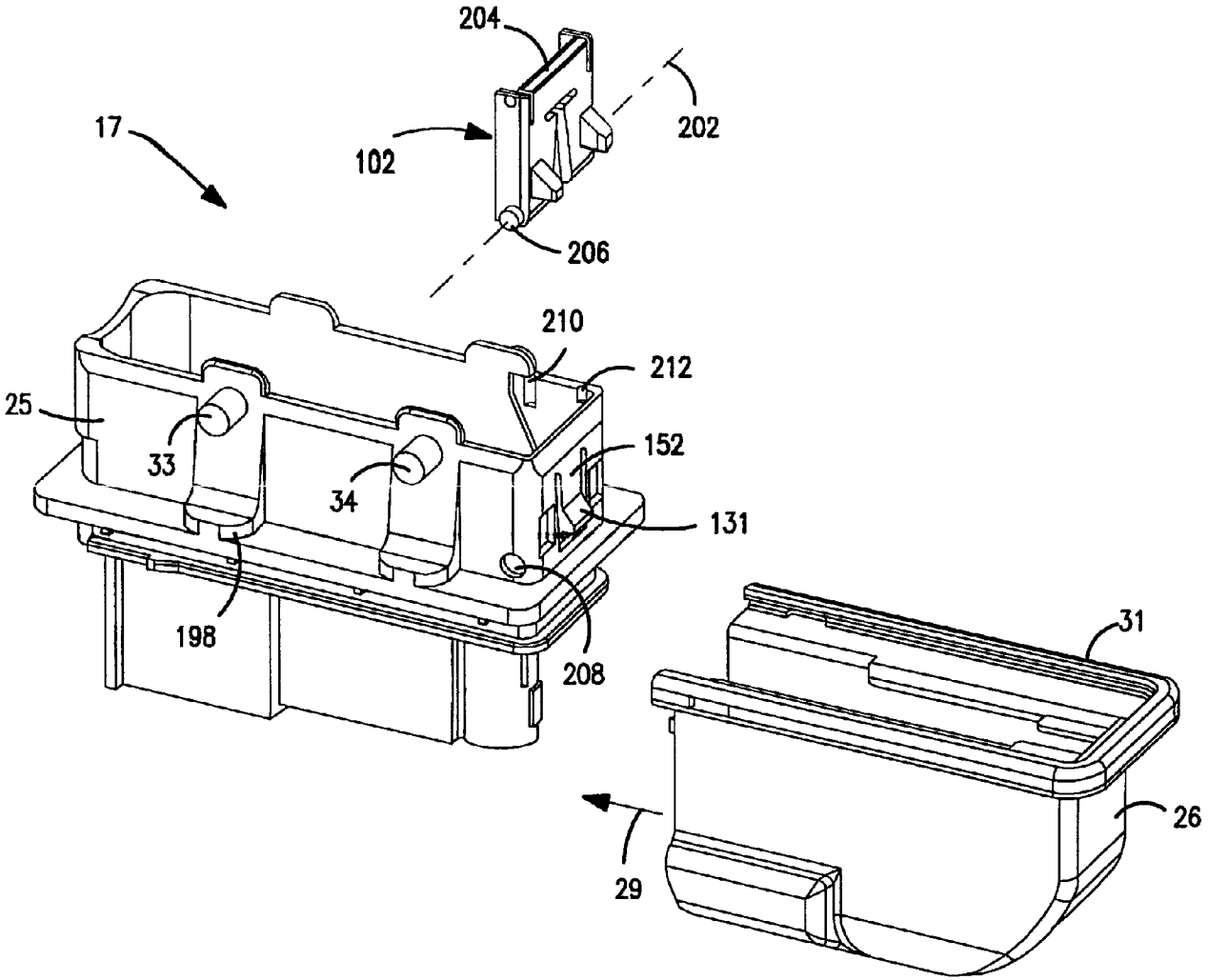
FIG. 8 is a perspective, partially exploded view of a second plug according to the second embodiment.

Referring to FIG. 8, the upper and lower guide rails 14, 15 cooperate with associated pin-like projections 33, 34 on the second plug 17 for clamping the first and second plugs 1, 17 together and against the partition wall 37. In accordance with the invention and in correspondence with the pin-like projections 33, 34, openings 72, 73 are provided in the first plug housing 2 through which the pin-like projections 33, 34 dip so as to cooperate with the sliding device 704, as shown in FIG. 7. The openings 72, 73 are provided with peripheral sealing members 163 in order to seal this connection region and prevent the penetration of moisture into the interior of the first plug 1.

A peripheral seal 28 is also attached to the first plug housing 2. In the illustrated embodiment shown in FIG. 7, the seal 28 is sprayed onto the first plug housing 2. The seal 28 is therefore secured captively on the first plug housing 2, and the connection between the seal 28 and the first plug housing 2 is invariably tight. However, the seal 28 can also be a separate member from the first plug housing 2. The foregoing similarly applies to the sealing members 163, which are also sprayed on the first plug housing in the illustrated embodiment.

In FIG. 8, the second plug 17 according to the second embodiment is shown in a partially exploded view. The elements of the second plug 17 which correspond to those in the first embodiment will not be mentioned again separately hereinafter.

As shown in FIG. 8, the pin-like projections 33, 34 are constructed integrally on the second plug housing 25. The pin-like projections 33, 34 are configured in such a way that the pin-like projections 33, 34 engage with the upper and lower guide rails 14, 15 of the sliding device 704 of the first plug 1 and thus represent an engagement member for the sliding device 704, which acts as the clamping device. Sealing projections 198, which are configured to form a tight joint with the sealing members 163, are also formed on the second plug housing 25 to assist in sealing the openings 72, 73.

Figure 10:
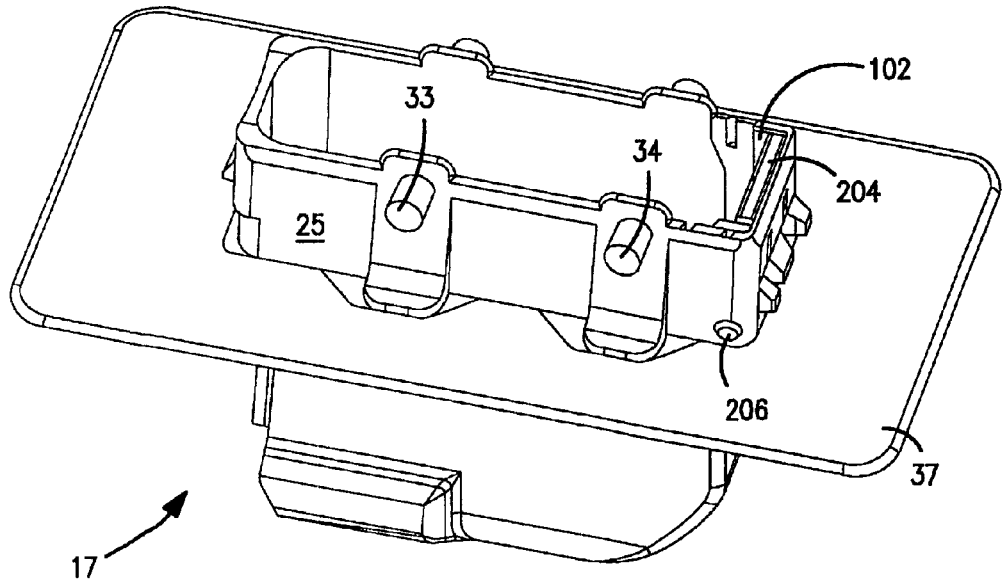
FIG. 10 is a perspective view of the second plug according to the second embodiment held in the partition wall.

A resilient catch arm 152 with a catch lug 131 in the form of a projection has the function of fastening the second plug 17 in the opening 39 in the partition wall 37, as will become apparent with reference to FIG. 10. A locking device 102 blocks the catch arm 152 in order to lock the second plug 17 in the partition wall 37 by preventing inward bending of the catch arm 152 in the locked state. As will become more apparent from FIGS. 15 and 16, the locking device 102 according to the second embodiment has bearing projections 206, which are held in corresponding bearing recesses 208 (FIG. 8) on the second plug housing 25. The locking device 102 can therefore be moved about an axis of rotation 202 between a locked position and an unlocked position. In the unlocked position, the locking device 102 is secured in a catch recess 210 and, in the locked position, in a catch recess 212.

Figure 9:
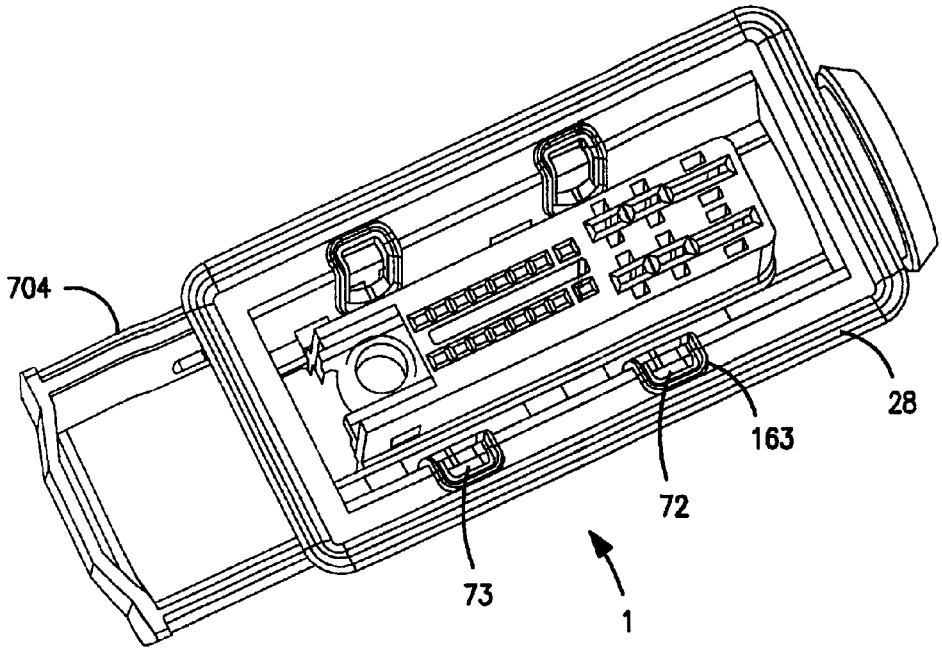
FIG. 9 is a perspective view of the first plug according to the second embodiment in a state ready for fitting.

FIG. 9 is a perspective view of the first plug 1 in a state ready for plugging. FIG. 10 shows the second plug 17 in a state ready for plugging with the locking device 102 being located in the locked position so that the second plug 17 is held securely in the partition wall 37. In this position, an edge 204 of the locking device 102 also makes contact with the second plug housing 25 so that a pin trough 128 (FIG. 16) in the second plug housing 25 is vacated and the first and second plugs 1, 17 can therefore be plugged together.

Figure 11:
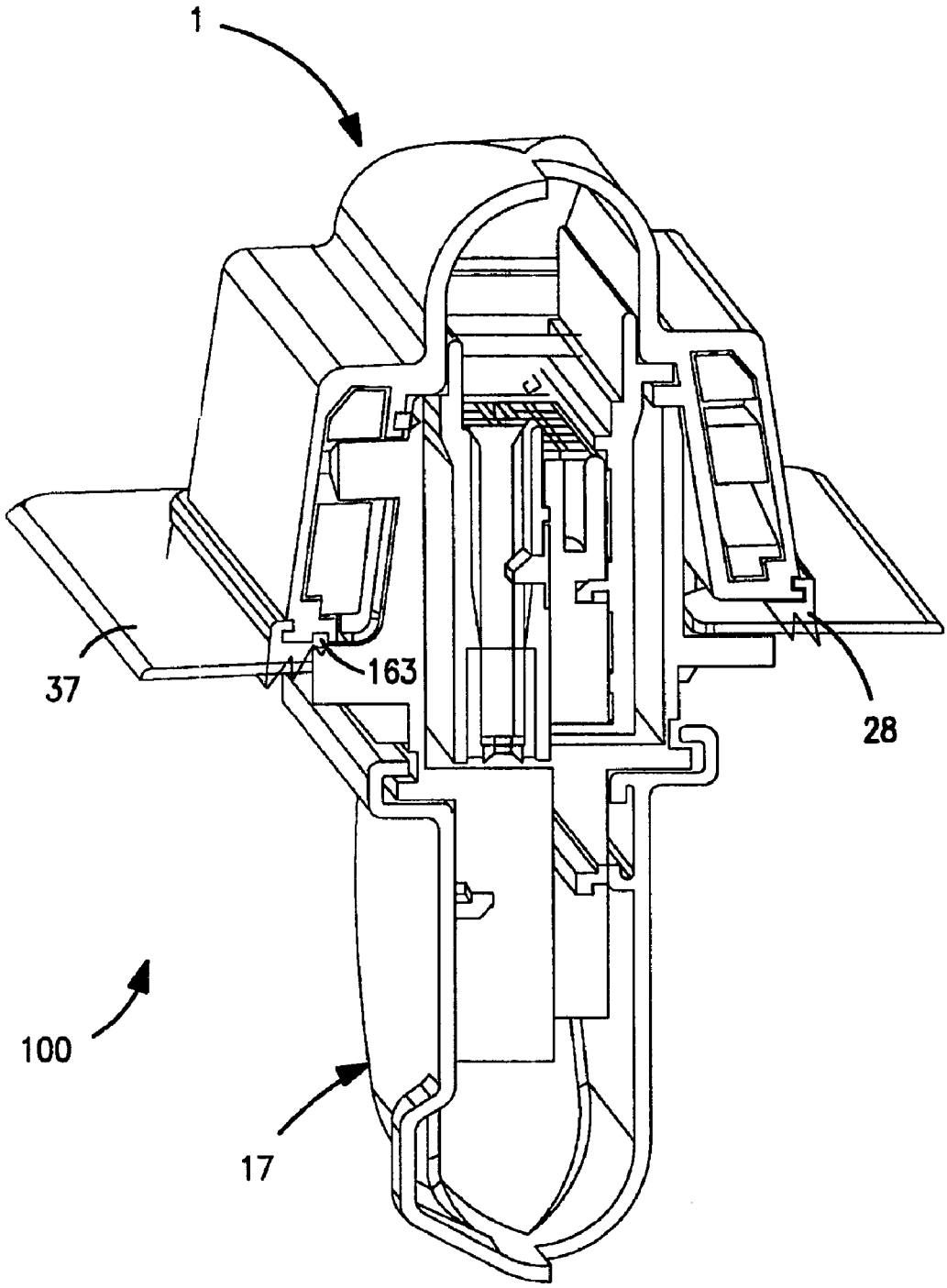
FIG. 11 is a perspective, partially open view of a plug connection according to the second embodiment fitted in an opening in a partition wall.

FIG. 11 shows a perspective, partially sectional view of the plug connection 100 according to the second embodiment of the invention in the finally fitted, plugged together state. According to the invention, the seals 28, and the sealing members 163 ensure that internal electrical connections are completely sealed against the penetration of moisture when the first and second plugs 1, 17 are firmly clamped with the partition wall 37.

The fitting of the second plug 17 in the partition wall 37 according to the second embodiment will be described in greater detail hereinafter with reference to FIGS. 12 and 13. In contrast to the previous embodiment, a seal 27 similar to the seal 28 is provided on the second plug 17 for providing a seal from the partition wall 37. It will be appreciated by one skilled in the art, however, that the side of the partition wall 37 on which the seal 27 is provided is immaterial to the principles according to the invention.

Figure 12:
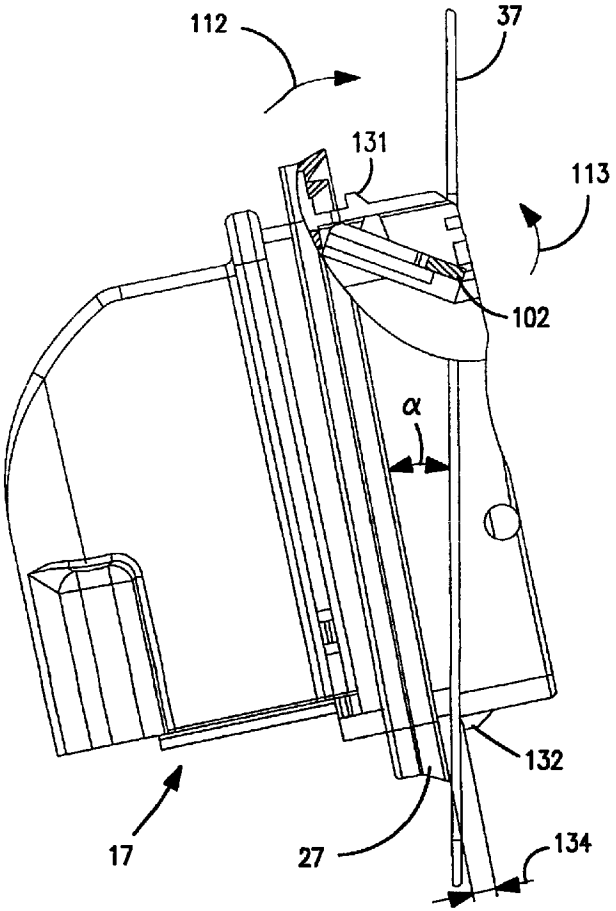
FIG. 12 is a partially sectional view of the second plug according to the second embodiment shown being fitted in the partition wall.

The locking device 102 is in the unlocked position, as shown in the partially open view in FIG. 12. For fitting, the second plug 17 is inserted obliquely into the opening 39 in the partition wall 37 a proposed free distance 134 ensuring that the necessary tilting about the angle $\alpha$ is possible.

After insertion, the second plug 17 is pivoted about a lower edge in a direction of arrow 112 so that the catch lug 131 also holds the second plug 17 in the partition wall 37. The locking device 102 can now be tilted in a direction of arrow 113, so that, on the one hand, inward pressing of the catch lug 131 is prevented and, on the other hand, projections 214, 216, which are shown more clearly in FIGS. 15 and 16, cooperate with the partition wall 37 so as to hold the second plug 17 in the opening 39 in the partition wall 37.

Figure 13:
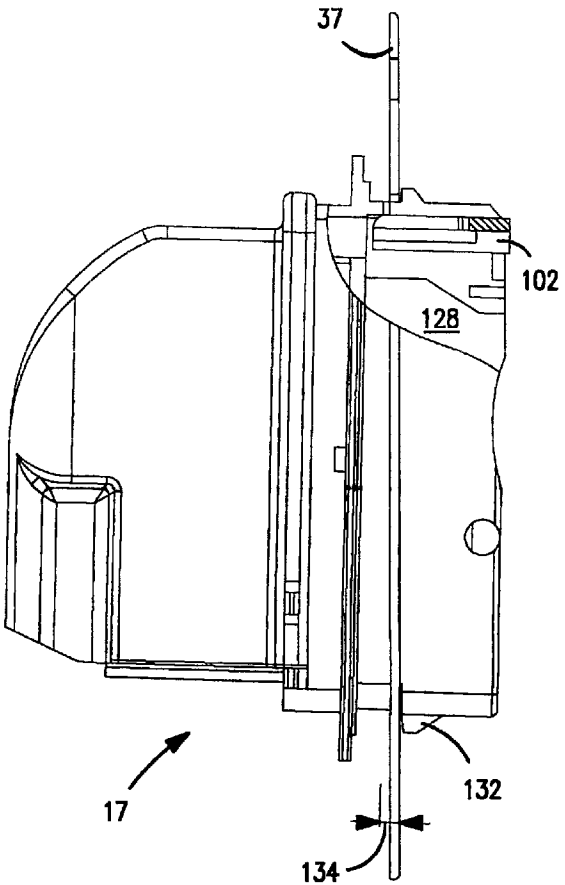
FIG. 13 is a partially sectional view of the second plug according to the second embodiment after fitting in the partition wall.

In the illustrated embodiment, the second plug 17 is still displaceable by the distance 134 transversely to the plugging-together direction in the pre-fitted position shown in FIG. 13. In the position of the locking device 102 shown in FIG. 13, the pin trough 128 is vacated so plugging together can now take place.

Figure 14:
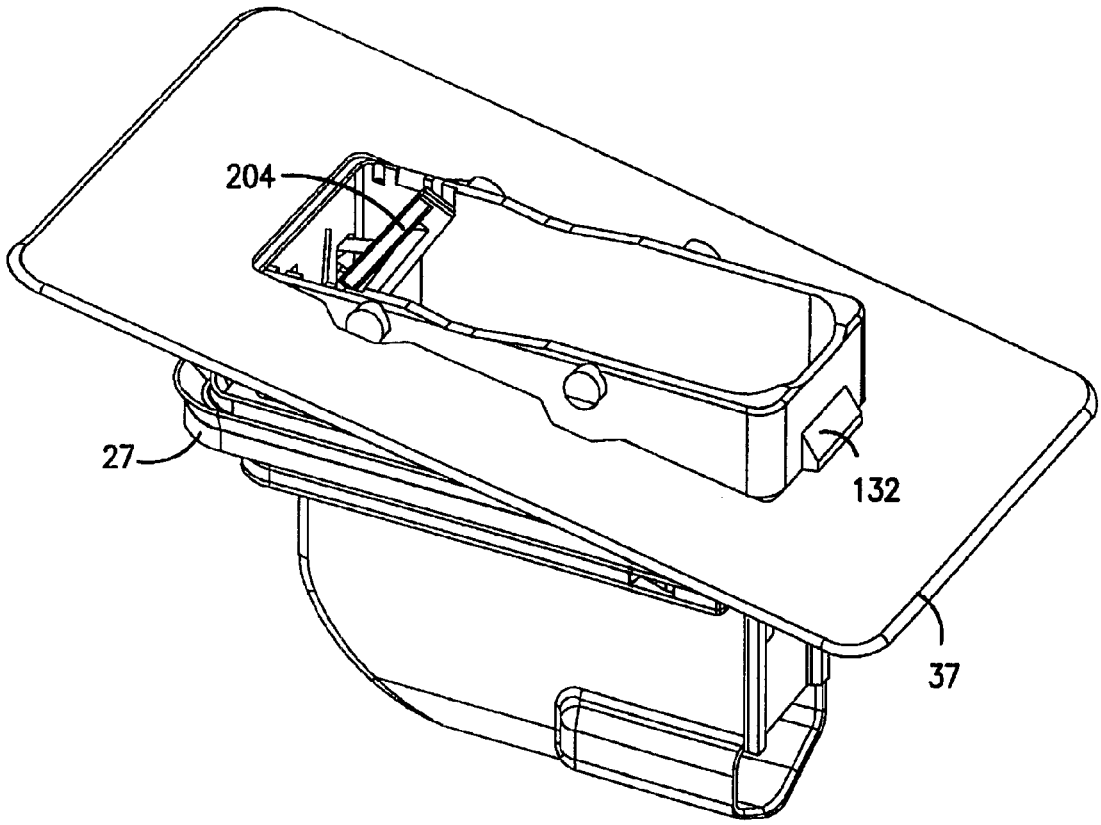
FIG. 14 is a perspective view of the second plug according to the second embodiment.

The fitting step shown in FIG. 12 is shown again in a perspective view in FIG. 14. It is apparent that the locking device 102, which is latched in the unlocked position in FIG. 12, blocks the pin trough 128 with its edge 204. This ensures that the second plug 17 and the first plug 1 can only be plugged together in the completely locked state. Fitting errors can thus be detected promptly and eliminated.

Figure 15:
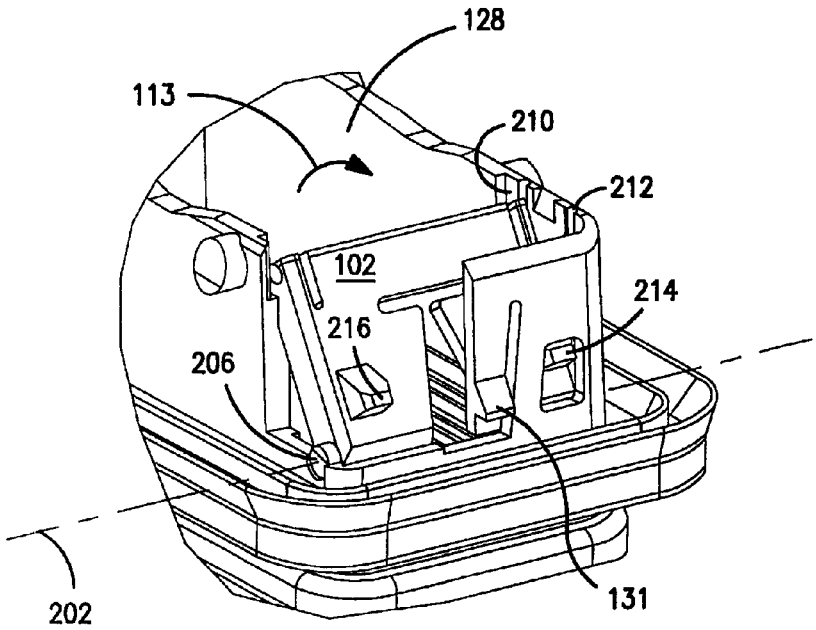
FIG. 15 is a perspective, detailed view of the second plug according to the second embodiment showing a locking device in a pre-fitted state.
Figure 16:
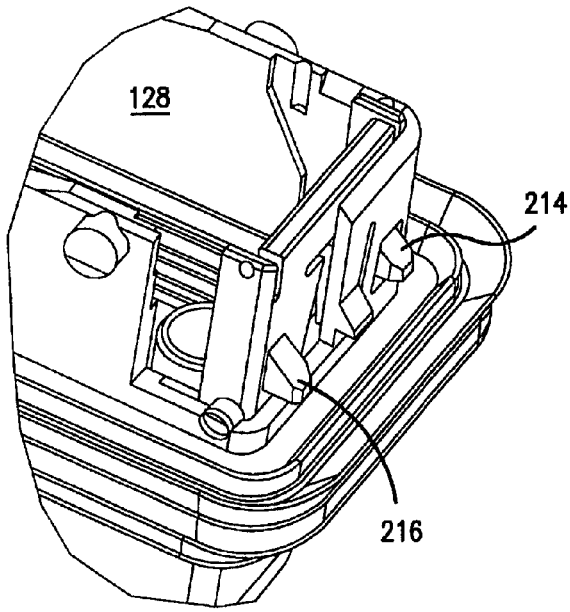
FIG. 16 is a perspective, partially open detailed view of the second plug according to the second embodiment showing the locking device in the locked state.
Figure 17:
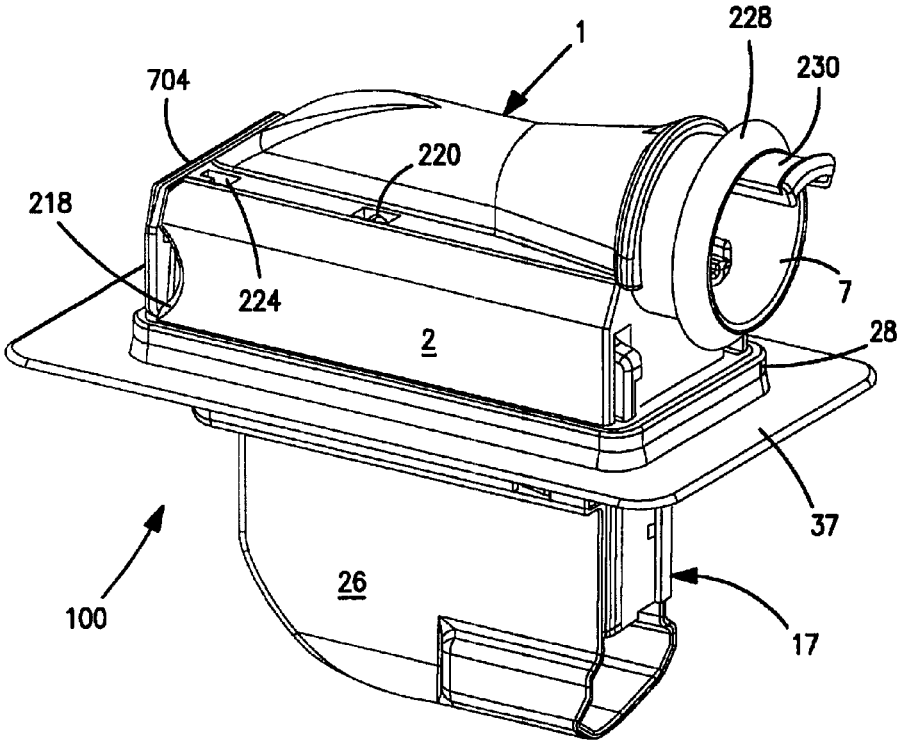
FIG. 17 is a perspective view of a plug connection fitted in an opening in a partition wall according to a third embodiment.

FIGS. 15 and 16 show two detailed views of the second plug 17, illustrating the mode of operation of the locking device 102 more clearly. FIG. 15 shows the unlocked state, in which the locking device 102 is latched in the catch recess 210 in such a way that the pin trough 128 for plugging the first and second plugs 1, 17 together is blocked. As will become apparent from comparison with FIG. 8, the locking device 102 is held in the bearing recesses 208 by the bearing projections 206 in such a way that it is pivotal in the direction of the arrow 113. In the locked position shown in FIG. 16, on the one hand, the movement of the catch lug 131 is blocked and, in addition, the projections 214, 216 dipping through the second plug housing 25 secure the second plug 17 directly in the partition wall 37. The second plug 17 is held in the partition wall 37 on the opposite face of the second plug housing 25 by a fixed holding structure 132 (FIG. 14).

FIGS. 17 to 26 show a third embodiment of the plug connection 100 according to the invention. As in the second embodiment, a sliding device 704 for clamping the first and second plugs 1, 17 together is provided. In order to be able to release the sliding device 704 without difficulty, if necessary, a recess 218 that allows a user to grasp the sliding device 704 securely is provided on either side of the first plug housing 2. Catch recesses 220, 224 with associated catch hooks 226 (FIG. 20) secure the sliding device 704 on the first plug housing 2. In particular, the catch hook 226 engages in the catch recess 220 in the finally fitted state and is secured by the catch recess 224 in the pre-fitted state.

In addition to a peripheral catch projection 228 shown in conjunction with the second embodiment, the connecting piece 7 has a resilient catch arm 230 in the embodiment shown here. Both the peripheral catch projection 228 and the catch arm 230 allow the mechanical fixing of a bush (not shown).

Figure 18:
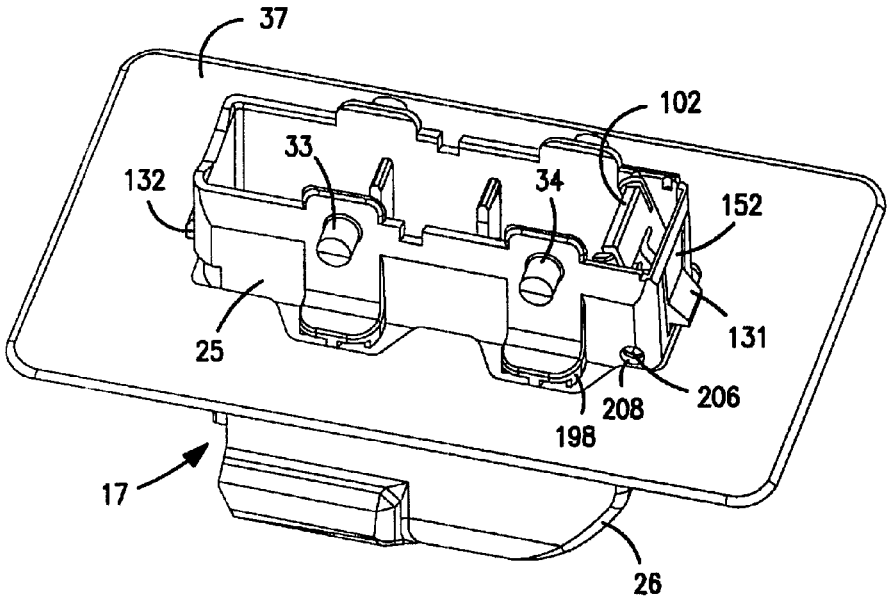
FIG. 18 is a perspective view of a second plug according to the third embodiment.
Figure 19:
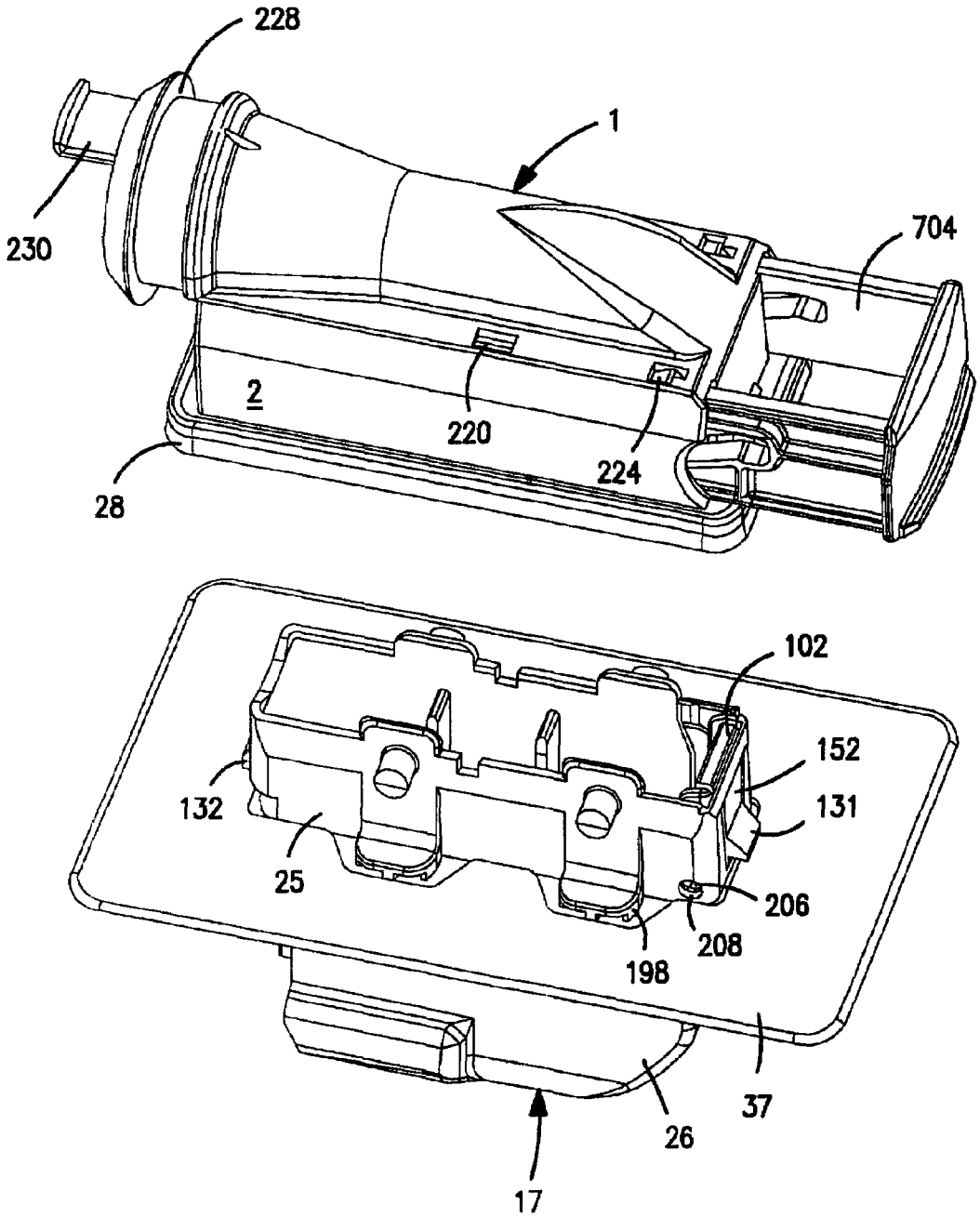
FIG. 19 is a perspective view of the plug connection according to the third embodiment before a first plug and the second plug are plugged together.
Figure 20:
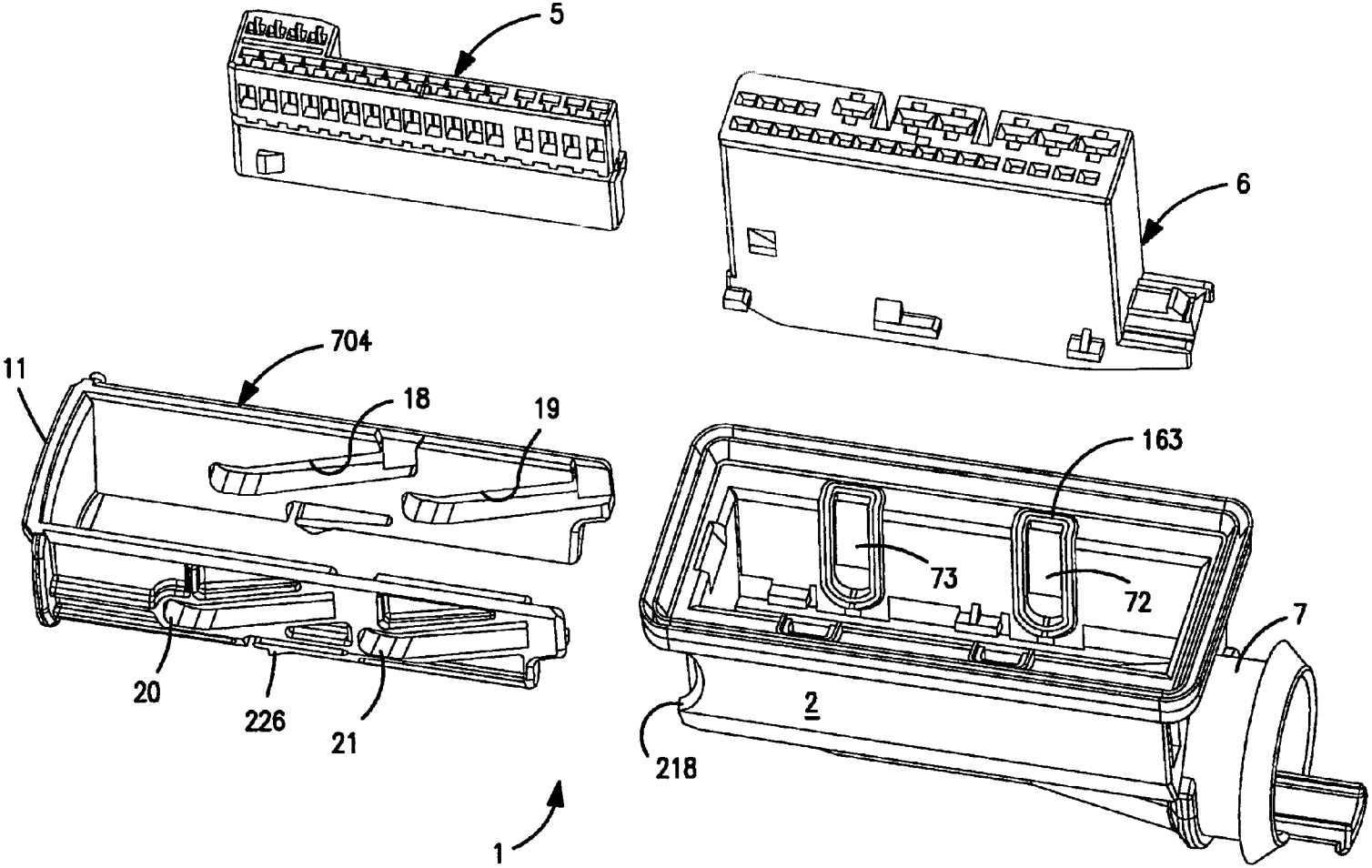
FIG. 20 is a perspective, partially exploded view of the first plug according to the third embodiment.

As shown in FIG. 18, the second plug 17 is positioned in the partition wall 37, but is not yet finally fixed. A locking device 102 is still in a pre-catching position. According to the present embodiment, locking in the partition wall 37 is achieved here solely via a resilient catch arm 152 and a catch lug 131 formed thereon and via an opposing holding structure 132. As shown in FIG. 19, the locking device 102 holds the catch arm 152 in the locked position in the finally latched state.

FIG. 19 shows the plug connection 100 before the first and second plugs 1, 17 are fitted together. The second plug 17 is held firmly in the partition wall 37 in this phase, and the locking device 102 holds the catch arm 152 in the position shown. The first plug 1 is located in a state ready for plugging, in which the sliding device 704 is latched by the catch recesses 224 in a pre-fitted state.

The explanations given with respect to the second embodiment basically also apply to the embodiment shown in FIG.

20. In particular, the functionality of openings 72, 73 provided with peripheral sealing members 163 and the sliding device 704 correspond to those of the second embodiment. As already mentioned, in the present embodiment, the sliding device 704 has the catch hooks 226 so that it can be held securely in the first plug housing 2 in both a pre-catch position and the finally fitted position. First pin recesses 5 and second pin recesses 6 are somewhat modified, however, this configuration should be taken only as an example, as the principles according to the invention can advantageously be employed with any plug shapes. Owing to recesses 218, an actuating face 11 of the sliding device 704 can extend rectilinearly in the third embodiment, and this reduces the space required.

Figure 22:
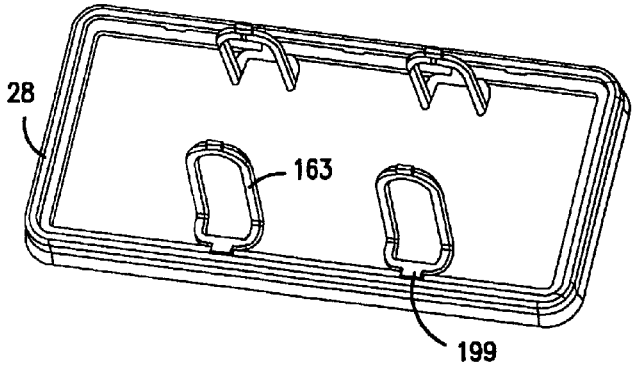
FIG. 22 is a perspective view of a single-part embodiment of seals on the first plug according to the third embodiment.

FIG. 22 shows a peripheral seal 28 for sealing the second plug 17 from the partition wall 37 and the sealing members 163 released from the plug connection 100. According to the present advantageous embodiment, the sealing members 163 are produced integrally with the seal 28 in that they are connected to the seal 28 via webs 199. This configuration has the advantage of simplified production as a separately laid in sealing arrangement and as a seal which is sprayed onto the plug 1. In the latter case, it is not necessary to provide undesirable injection points on the fine structures of the sealing members 163. In addition, this embodiment allows a reliable seal in the region of projections 33, 34.

Figure 21:
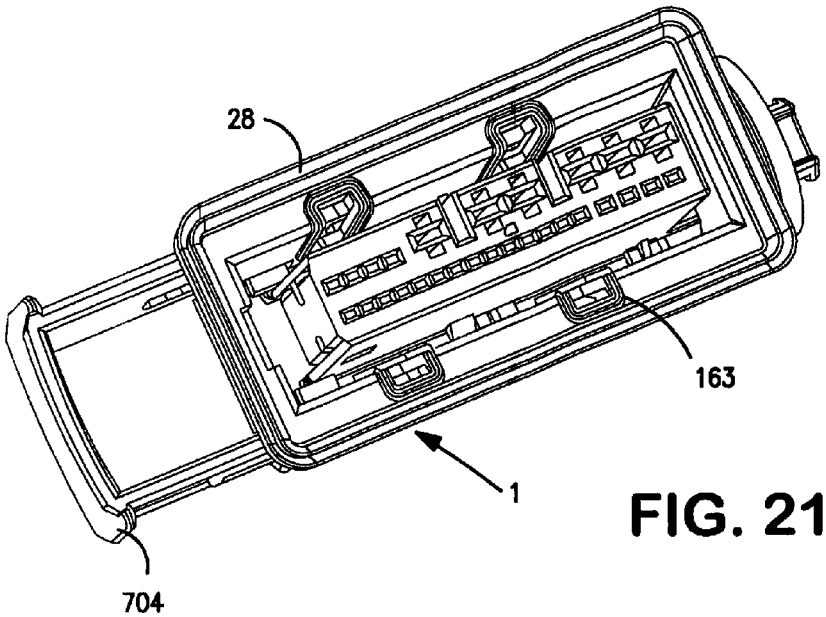
FIG. 21 is a perspective view of the first plug according to the third embodiment in a state ready for fitting.
Figure 23:
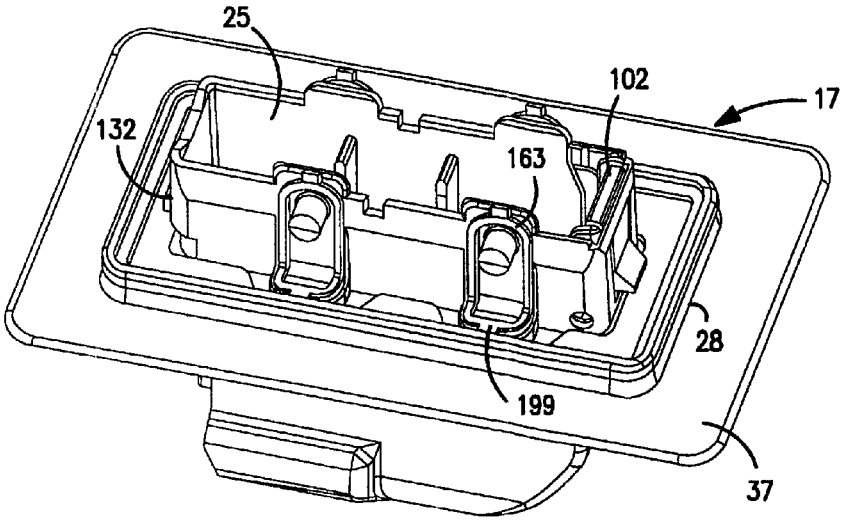
FIG. 23 is a perspective view of the second plug according to the third embodiment held in the partition wall with seals.

FIG. 23 shows the second plug 17 in a state ready for plugging with the second plug 17 being fitted in the partition wall 37 and the seal 28, and the sealing members 163 from FIG. 21 also being shown to illustrate the position thereof. In this embodiment, the seal 28 and the sealing members 163 are in turn constructed in one piece in that the webs 199 produce a joint.

Figure 25:
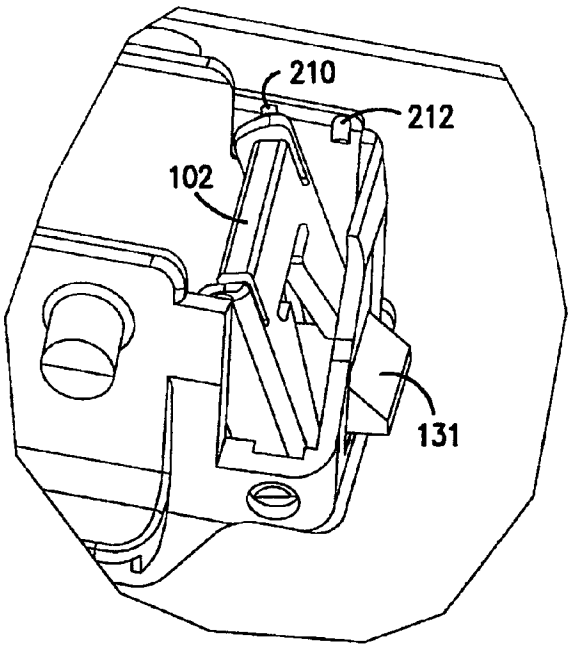
FIG. 25 is a detailed view of Section D from FIG. 24.
Figure 24:
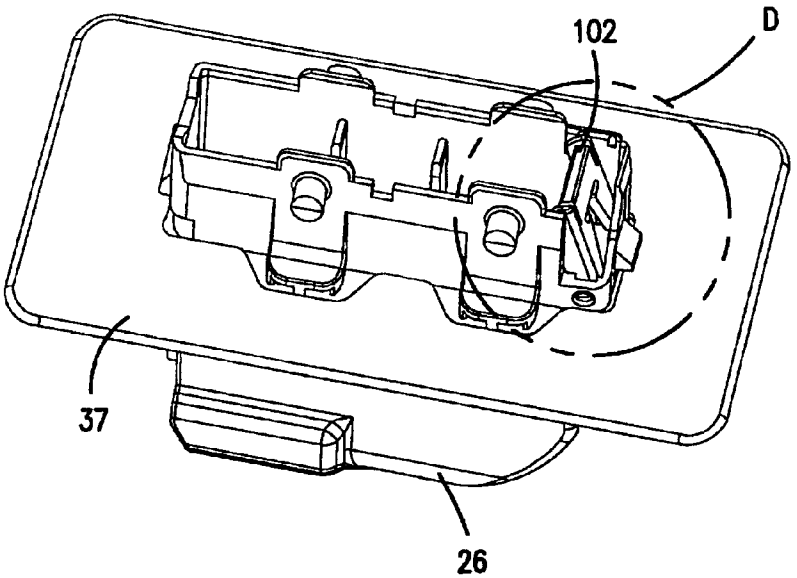
FIG. 24 is a perspective, partially open view of the second plug according to the third embodiment with an unlocked locking device.

FIGS. 24 and 25 show the configuration of the locking device 102 in the unlocked position. The functionality of the locking device 102 basically corresponds to the principles described with reference to FIGS. 15 and 16.

Figure 26:
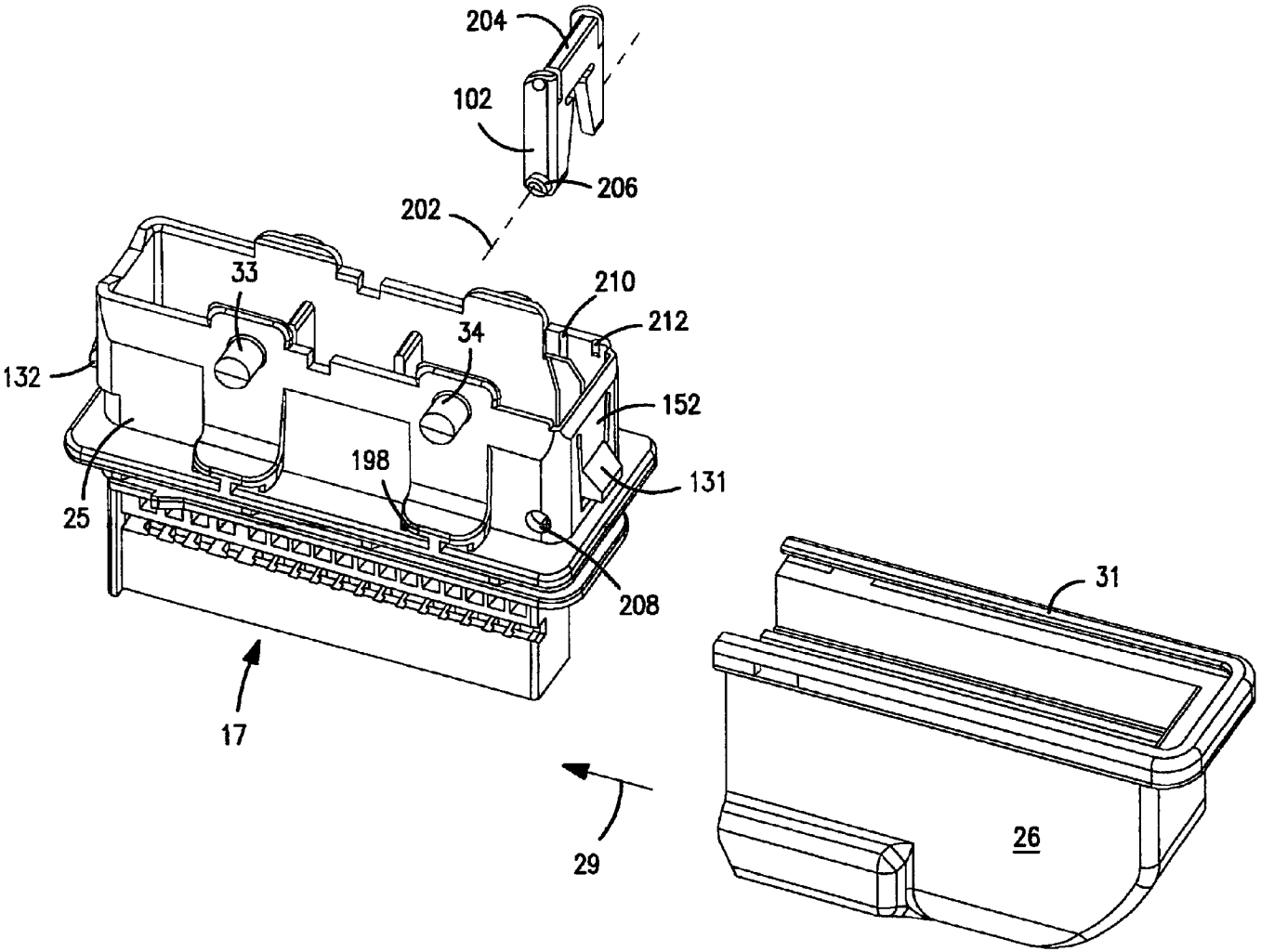
FIG. 26 is a perspective, partially exploded view of the second plug according to the third embodiment.

FIG. 26 shows the second plug 17. In comparison with the similar embodiment shown in FIG. 8, the simplified configuration of the pivotal locking device 102 is of particular importance in this embodiment. The locking device 102 is configured without the projections 214, 216 dipping through the second plug housing 25. Regardless of this, however, any functional mechanisms described with respect to the foregoing configurations can also be transferred to the present embodiment.

With the aid of the plug connection 100 according to the invention, on the one hand, the tightness cannot be influenced by the pull of the cable and, on the other hand, an optimum sealing function relative to the partition wall 37, for example a vehicle body panel, is ensured owing to the axial seal 28 at the first plug 1. The pin trough 128 is protected from dripping water, and fitting as well as removal are simple and clear. Closure of the coupling produces a defined sealing fit between the second plug 17 and partition wall 37 in addition to the electrical contact. Additionally, a seal can be ensured by the deep trough and the high protective web 199.

What is claimed is:

1. An electrical plug connection, comprising:

a first plug having a peripheral seal and a first plug housing having sidewalls, and each of the sidewalls having at least one projection receiving opening formed therein;

a second plug configured for fitting in a partition wall opening, the second plug having an extended portion being insertable into the first plug such that the peripheral seal substantially surrounds the partition wall opening when the first and second plugs are mated;

a clamping device provided on the first plug that is configured for drawing the first plug into engagement with the second plug, the clamping device engaging with the second plug through the at least one projection receiving opening and;

a sealing member arranged around each projection receiving opening and configured to seal each of the projection receiving openings and the extended portion between the clamping device and the second plug.

2. The plug connection of claim 1, wherein the clamping device is a sliding device including at least one guide rail that engages with a pin-like projection formed on the extended portion of the second plug.

3. The plug connection of claim 2, wherein the projection extends through a respective projection receiving opening in the first plug housing and into engagement with the guide rail of the sliding device.

4. The plug connection of claim 2, wherein the clamping device is slideable in a direction substantially transverse to a direction of engagement of the first and second plugs.

5. The plug connection of claim 1, wherein the second plug is provided with a sealing projection configured for engagement with the sealing member.

6. The plug connection of claim 1, wherein the sealing member is an O-ring.

7. The plug connection of claim 1, wherein the sealing member is a spray-on seal.

8. The plug connection of claim 1, wherein the second plug includes a resilient catch arm configured for engagement with the opening.

9. The plug connection of claim 8, wherein the second plug includes a locking device moveable to a locked position for preventing movement of the resilient catch arm when the resilient catch arm is engaged with the opening.

10. The plug connection of claim 9, wherein the locking device is mounted on the second plug by a hinge-like connection.

11. The plug connection of claim 9, wherein the locking device prevents engagement of the first and second plugs when the locking device is not in the locked position.

* * * * *